US008944131B1

(12) United States Patent
Williams

(10) Patent No.: US 8,944,131 B1
(45) Date of Patent: Feb. 3, 2015

(54) ADHESIVE TAPE DISPENSER WITH AUTOMATIC WINDING OF RELEASABLE BACKING

(71) Applicant: Jerry Williams, La Belle, FL (US)

(72) Inventor: Jerry Williams, La Belle, FL (US)

( * ) Notice: Subject to any disclaimer, the term of this patent is extended or adjusted under 35 U.S.C. 154(b) by 232 days.

(21) Appl. No.: 13/717,051

(22) Filed: Dec. 17, 2012

Related U.S. Application Data

(60) Provisional application No. 61/577,197, filed on Dec. 19, 2011.

(51) Int. Cl.

| | |
|---|---|
| ***B65H 35/07*** | (2006.01) |
| ***B65H 35/00*** | (2006.01) |
| ***B65H 35/06*** | (2006.01) |
| ***B65H 79/00*** | (2006.01) |
| *B65H 37/00* | (2006.01) |

(52) U.S. Cl.
CPC ..... *B65H 35/002* (2013.01); *B65H 35/06* (2013.01); *B65H 79/00* (2013.01); *B65H 37/005* (2013.01); *B65H 35/0033* (2013.01)
USPC ..... 156/527; 156/523; 156/577; 156/579; 156/65

(58) Field of Classification Search
CPC . B65H 35/0033; B65H 35/002; B65H 37/005
USPC ..... 156/523, 526, 527, 574, 577, 579
See application file for complete search history.

(56) References Cited

U.S. PATENT DOCUMENTS

| | | | | |
|---|---|---|---|---|
| 2,656,063 | A * | 10/1953 | Kafka | 156/384 |
| 4,075,944 | A * | 2/1978 | Conley | 101/94 |
| 4,561,926 | A * | 12/1985 | Hamisch et al. | 156/381 |
| 5,384,003 | A * | 1/1995 | Mitchell | 156/510 |
| 7,121,499 | B2 * | 10/2006 | Lammers et al. | 242/588.6 |
| 7,762,303 | B2 * | 7/2010 | Yu Chen | 156/579 |
| 8,028,734 | B2 * | 10/2011 | Wermuth | 156/361 |
| 8,066,045 | B2 * | 11/2011 | Sleiman | 156/351 |
| 2005/0061450 | A1 * | 3/2005 | Petitti | 156/577 |
| 2006/0144512 | A1 * | 7/2006 | Carroll et al. | 156/304.3 |
| 2006/0260762 | A1 * | 11/2006 | Yu Chen | 156/584 |
| 2010/0126671 | A1 * | 5/2010 | Yu Chen | 156/577 |

* cited by examiner

*Primary Examiner* — Mark A Osele
(74) *Attorney, Agent, or Firm* — H. John Rizvi; Gold & Rizvi P.A.

(57) ABSTRACT

The invention is directed to an adhesive tape dispenser adapted for use with adhesive tape having a releasable backing such as wax paper, foil or vinyl often used in HVAC applications. The adhesive tape dispenser includes a handgrip for holding the tape dispenser in one hand during use, a finger switch provided on the handgrip and activated to operate a motorized gearing system for automatically removing and storing the releasable backing simultaneously while applying the adhesive tape to a surface, and a light source for illuminating dark or low lit surface areas.

10 Claims, 7 Drawing Sheets

ADHESIVE TAPE DISPENSER WITH AUTOMATIC WINDING OF RELEASABLE BACKING

CROSS-REFERENCE TO RELATED APPLICATION

This application claims the benefit of U.S. Provisional Patent Application Ser. No. 61/577,197 filed on Dec. 19, 2011 which is incorporated herein in its entirety.

FIELD OF THE INVENTION

The present invention relates generally to dispensers. More particularly, the present disclosure relates to an adhesive tape dispenser including a handgrip for holding the dispenser in one hand during use, a motorized gear system for automatically removing and storing a releasable backing from adhesive tape while simultaneously applying the adhesive tape to a surface, and a light source for illuminating application surfaces in dark or low lit areas.

BACKGROUND OF THE INVENTION

There are different kinds of adhesive tape for use in a broad range of applications. Adhesive tape typically comprises an elongated substrate having an adhesive material disposed on one side of the substrate. A predefined length of tape is generally wound on a spool, for storage, forming a roll of tape. Adhesive tape can be found in hobby shops, craft stores, schools, and in homes. Exemplary types of adhesive tape include masking tape, Duct® tape, and transparent tape just to name a few. Other types of adhesive tape have also been developed specifically for use in industry. For example, electrical tape is used for covering electrical wires, plastic tape is used in plumbing, and double-sided tape for attaching objects to various surfaces. Adhesive tape has also been tailored for use in the heating, ventilation, and air conditioning (HVAC) industry. Such tapes generally include vinyl adhesive tape, foil adhesive tape, or paper adhesive tape, and are used to seal joints and seams of piping and ducts. The adhesive tape used in the HVAC industry typically includes a substrate having an adhesive material disposed on one side, and a releasable backing, such as wax paper, vinyl or foil that covers the adhesive material prior to use.

Negotiating the releasable backing while simultaneously applying the adhesive tape to an application surface can be frustrating, time consuming, and burdensome. A corner of the adhesive tape is usually bent and otherwise manipulated to separate the releasable backing from the adhesive tape which generally requires the use of both hands. The task of removing the releasable backing poses a burden on workers in that workers have to stop what they're doing, put down their tools, and attempt to separate the releasable backing from the adhesive tape. The task is compounded in adverse weather conditions where cold weather affects the use of a worker's hands and fingers. In use, laborers hold a large roll of adhesive tape in one hand while applying adhesive tape to an application surface using the free hand. The free hand is often used to align the tape correctly on the surface and to apply pressure to the applied tape to smooth out tape and force the adhesive tape to adequately stick to the surface. While on a the job, workers have to peel the releasable backing from the adhesive tape to expose the adhesive material, apply the adhesive tape to a surface, and then cut the releasable backing for proper disposal. The coordinated efforts required in properly applying adhesive tape, having a releasable backing, often results in the adhesive tape rolling back on itself and sticking together, the adhesive tape wrinkling or bulging, or incorrectly being applied on a surface.

Conventional prior art dispensers have been introduced to assist individuals in dispensing adhesive tape. Some dispensers include a housing having a cavity for storing a roll of adhesive tape, and a front end section having a distal serrated cutting edge designed for cutting the adhesive tape. Generally, these devices allow the user to extract a length of tape from a tape reel and tear off or cut off a desired length. Though such tape dispensers satisfy many applications, the prior art dispensers are not tailored for use with adhesive tapes having a releasable backing, such as wax, paper, foil or vinyl layer.

Traditional dispensers developed for use with adhesive tapes having a releasable backing, have typically employed mechanical methods for removing the releasable backing to expose the adhesive material prior to application. Many conventional dispensers include mechanisms that are designed to separate the releasable backing from the adhesive tape, however, such devices lack the adequate ability to properly collect and store the loose releasable backing once removed forcing users to clean the dispenser and discard the material after each use. Further, such prior art dispensers are bulky, heavy, and often difficult to use with one hand, limiting the ability to apply adhesive tape around piping or duct work that is located in confined or difficult areas. Another disadvantage of prior art dispensers for dispensing adhesive tape having a releasable backing is that the devices do not include a lighting device to provide illumination. Workers are required to transport external lighting devices such as lamps or flashlights on a job site to illuminate application surfaces in dark or low lit areas.

SUMMARY OF THE INVENTION

The present invention overcomes the deficiencies of the known art and the problems that remain unsolved by providing an adhesive tape dispenser adapted for use with adhesive tape having a releasable backing, such as paper, where the tape dispenser includes a motorized gear system for automatically removing and storing the paper layer while simultaneously applying the adhesive tape to a surface. The adhesive tape dispenser also includes a light emitting diode for illuminating an application surface in dark or low lit areas, and includes a handgrip for conveniently holding the tape dispenser in one hand during use.

In accordance with one implementation of the present invention, there is provided an adhesive tape dispenser on which a roll of adhesive tape having a releasable backing is removably mounted, said adhesive tape dispenser comprising:

a first shell integrally formed to include a firsthand member;

a second shell integrally formed to include a second hand member, each of the shells including a top platform, and a bottom platform having a curved rear section and a front wall;

a roll fastener that is disengage able to provide replacement of the roll of adhesive tape;

a reel opening formed within the first shell and including a pair of finger openings extending outward from the perimeter of the reel opening;

a reel fastener pivotably mounted on the first shell to close the reel opening;

a motorized gear system operated to automatically wind the releasable backing into a roll of releasable backing that is removably secured within the reel opening via, the reel fastener;

a power source;

a finger switch electrically connecting the power source to the motorized gear system; and wherein the first shell is fastened to the second shell to form a cavity for storing the roll of adhesive tape and a chamber enclosing the motorized gear system, and wherein the hand members form a handgrip having a removable end cap and a switch opening to accommodate the finger switch, the power source being removably disposed within the handgrip.

In an aspect, the motorized gear system includes a DC motor, a driver gear, a planetary gear, and a take-up gear operatively aligned within the reel opening where the motor is mechanically coupled to the driver gear and selectively operated via, the finger switch to rotate the planetary gear and the take-up gear to wind the releasable backing from the roll of adhesive tape simultaneously as the adhesive tape is extracted from the adhesive tape dispenser.

In another aspect, the driver gear, planetary gear and the take-up gear are operatively mounted to a gear plate that is fastened to an interior surface of the outer shell.

In another aspect, the adhesive tape dispenser further includes an application guide having a convex outer edge. The application guide is fastened to both the inner shell and the outer shell by mounting fasteners.

In another aspect, the adhesive tape dispenser further includes a first guide roller and a second guide roller where the guide rollers rotatably engage the adhesive tape as the adhesive tape is extracted from the adhesive tape dispenser between the guide rollers.

In another aspect, the adhesive tape dispenser includes a printed circuit board for electrically connecting the power source to the DC motor and the finger switch. The printed circuit board is safely enclosed within the chamber. The power source includes one or more replaceable batteries, rechargeable batteries, or power packs.

In another aspect, the handgrip includes a plurality of finger recesses formed along a longitudinal axis of the handgrip to provide comfort and enhance a user's grip.

In another aspect, the adhesive tape dispenser further includes a light emitting diode mounted on the printed circuit board and situated above the finger switch to illuminate an application surface when using the adhesive tape dispenser. The light emitting diode is electrically coupled to the finger switch and power source.

In another aspect, the application guide includes a serrated cutting edge for cutting a predetermined length of adhesive tape.

In accordance with another implementation of the present invention, the invention comprises a adhesive tape dispenser adapted to dispense adhesive tape that is wound on a roll and includes a backing substrate that is peeled to expose adhesive material of the adhesive tape prior to application, said adhesive taped dispenser comprising:

a frame including a cavity in which the spool of adhesive tape is rotatably mounted therein, and a handgrip extending downwards from the frame and including a removable end cap;

an application guide attached at a distal end of the frame;

a pair of guide rollers mounted at the distal end of the frame where the adhesive tape is disposed between the pair of guide rollers when the adhesive tape is extracted from the adhesive tape dispenser;

a spool fastener removably fastened to accommodate replacement of the spool of adhesive tape;

a collection chamber formed within the frame and adapted to store the backing substrate as the backing substrate is removed from the adhesive tape and wound into a coil;

a removable closure closing the collection chamber to prevent the coil from exiting the collection chamber;

a driver gear, a planetary gear, and a take-up gear aligned to rotate within the collection chamber, said gears interconnected with each other to rotate;

an electrical motor mechanically coupled to the driver gear;

a power source secured within the handgrip; and an electrical switch disposed within the handgrip and protruding outwardly from a switch opening formed within the handgrip so that users may operate the electrical switch with a finger when holding the handgrip in one hand. The electrical switch is selectively operated to electrically couple the power source to the motor to rotate the driver gear so that the take-up gear winds the backing substrate within the collection chamber to form the coil.

In accordance with another implementation of the present invention, the invention comprises a releasable sheet tape dispenser comprising:

a handheld housing including a pistol grip and opening having a disengage able fastener to accommodate replacement of a roll of adhesive tape including a releasable sheet, the housing having a distal opening to receive said releasable sheet there through;

a pair of rollers aligned vertically one top of each other to rotatably engage the adhesive tape that extends between the pair of rollers when the adhesive tape is extracted from the dispenser;

a cavity formed within the housing and adapted to receive and store the releasable sheet as the releasable sheet is removed from the adhesive tape and wound within the cavity to form a roll of releasable sheet where the cavity includes a removable closure to prevent the roll of releasable sheet from exiting the cavity;

interconnecting gears enclosed within the housing and releasably attached to the releasable sheet;

an electric motor coupled to the interconnecting gears;

a power source; and an electrical switch situated about the pistol grip and selectively connecting the power source to the electric motor to wind the releasable sheet within the cavity simultaneously as the adhesive tape is extracted through the pair of rollers, and an interchangeable guide attached to the distal end of the housing.

In an aspect, the releasable sheet, releasable backing and backing substrate comprises any one of foil, wax paper, plastic, or vinyl.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
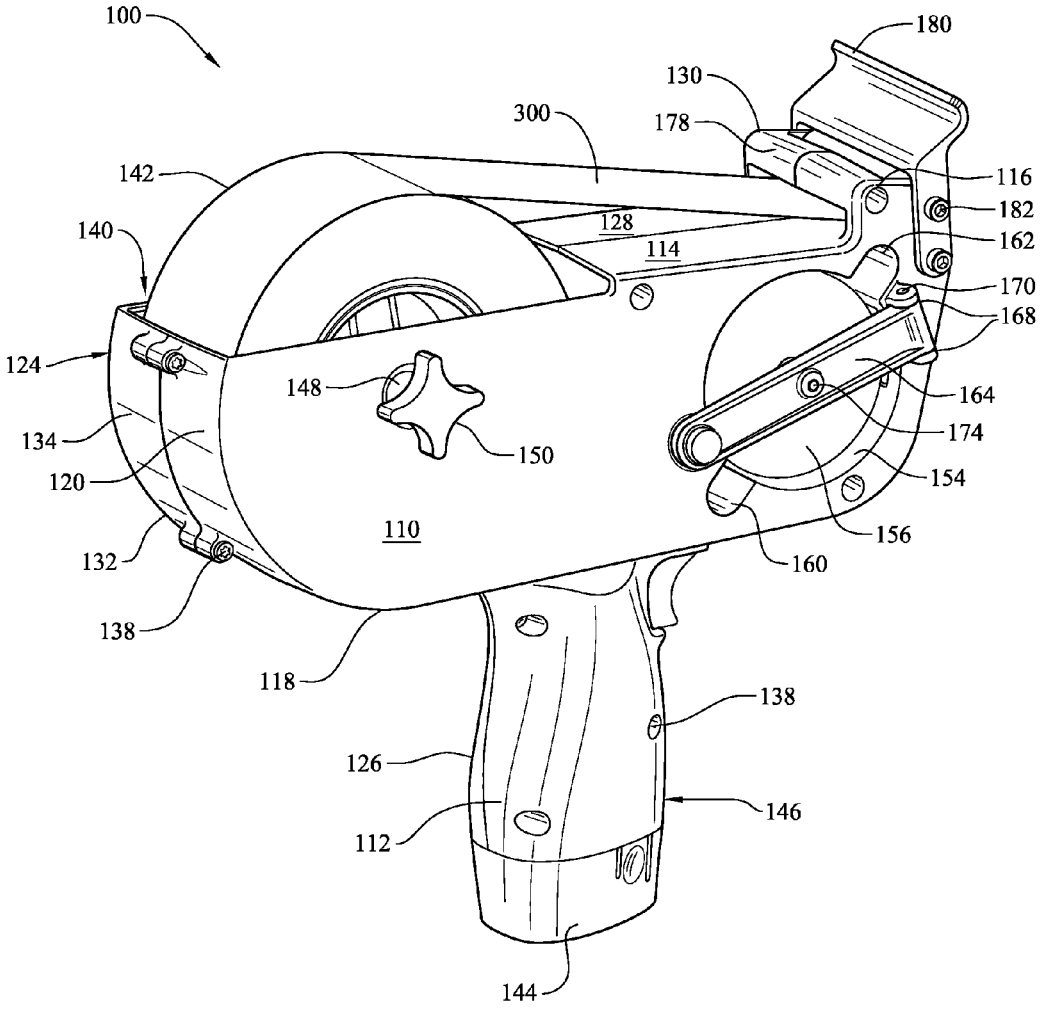
FIGS. 1 and 2 present perspective views of an inner side of an adhesive tape dispenser, with a roll of adhesive tape, including a releasable backing, supported within the dispenser housing, and a length of adhesive tape uncoiled from the roll and extending forwardly through guide rolls, in accordance with one embodiment of the present invention.
Figure 2:
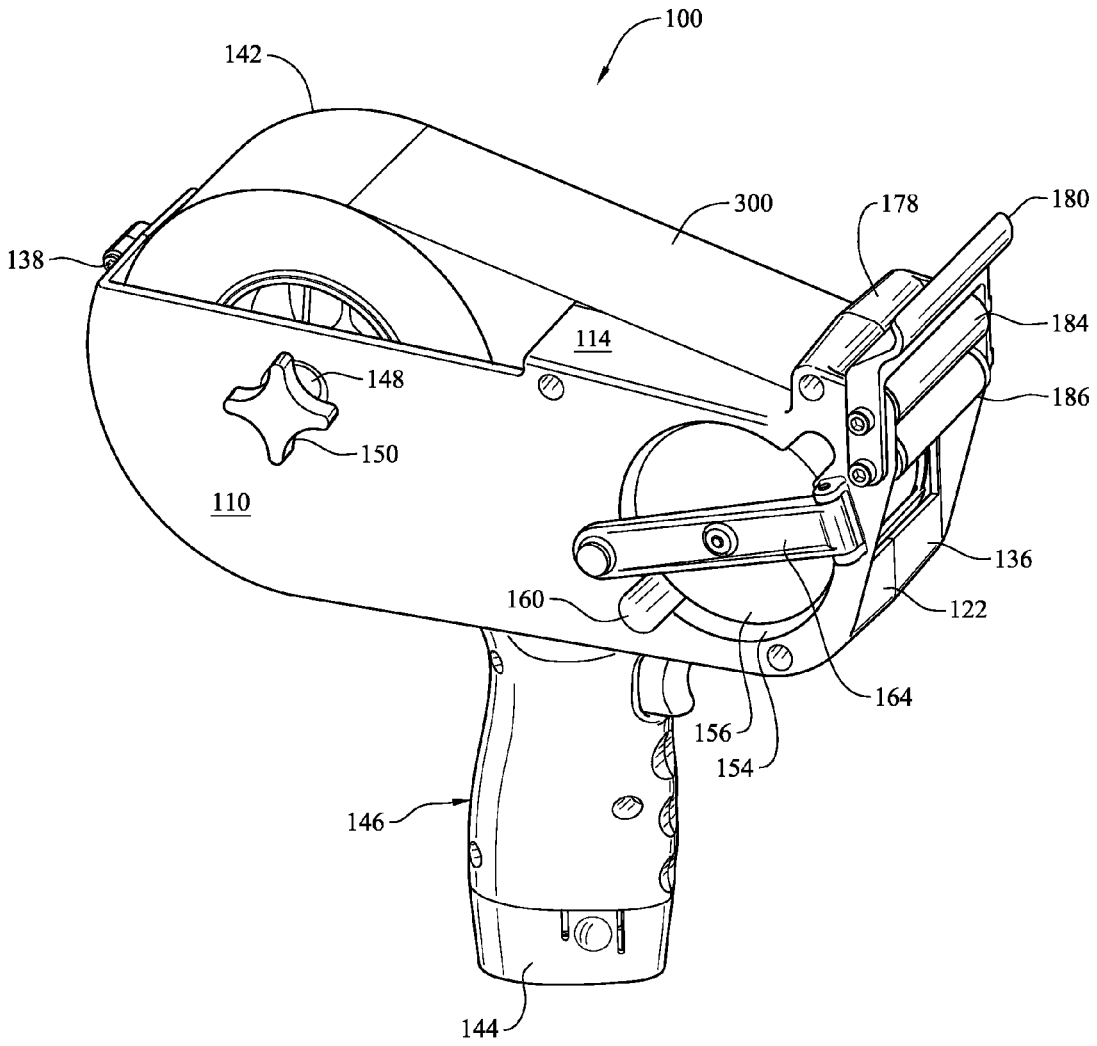

Referring to FIGS. 1 and 2, there are shown perspective views illustrating an inner side of an adhesive tape dispenser 100, in accordance with the embodiment of the present invention. Adhesive tape dispenser 100 comprises an inner shell 110 including an integrally formed hand member 112, a top platform 114, a riser 116, and a bottom platform 118 having a curved rear section 120 and an upwardly extending front wall 122. Top and bottom platforms 114, 118 are integrally formed to extend perpendicular to the body of the inner shell 110. Also included is an outer shell 124 including an integrally formed hand member 126, a top platform 128, a riser 130, and a bottom platform 132 having a curved rear section 134 and an upwardly extending front wall 136. Front walls 122, 136 are better illustrated in FIG. 2. Top and bottom platforms 128, 132 are integrally formed perpendicular to the body of the outer shell 124. The inner and outer shells 110, 124 are securely fastened together via, shell fasteners 138, such as screws, such that the top and bottom platforms 114, 128, 118, 132 butt against each other to provide spacing formed between the inner shell 110 and outer shell 124 to define a tape dispenser housing including a cavity 140 sized and dimensioned to receive a roll of adhesive tape 142 therein. The tape dispenser housing also provides a chamber for enclosing a motorized gear system and electrical circuitry for operating the adhesive tape dispenser 100. An end cap 144 used to also join hand members 112, 126 together, and to provide a closed bottom defining a handgrip 146 for holding the adhesive tape dispenser 100 in one hand. In one embodiment, the inner shell 110 and outer shell 124 are preferably constructed from a durable, lightweight material such as thermosetting plastics comprising any of polyurethanes, epoxy resins, or phenolic resins, although the shells 110, 124 may also be constructed from a metal material for use in various industries.

It will be noted that reference made to a roll of adhesive tape 142, as illustrated and described herein, comprises an adhesive tape having an adhesive substrate and a releasable backing 400, such as wax paper, foil or vinyl, that is releasably disposed over the adhesive substrate. The roll of adhesive tape 142 is generally used in HVAC applications for repairing cracks or sealing joints or seams in duct work. In the exemplary embodiment, the roll of adhesive tape 142 comprises 3 inches in width and 5⅞ inches in diameter. The roll of adhesive tape 142 typically includes an elongated substrate that is wound around a tape spool having a central hub that generally includes a lateral opening which spans the width of the hub.

Adhesive tape dispenser 100 of the present invention includes a roll fastener 148 for removably securing the roll of adhesive tape 142 within cavity 140 of the housing. In one non-limiting embodiment, roll fastener 148 includes a rod (not shown) having a threaded distal end, and a knob 150 affixed to a proximal end of the rod for rotating the rod by hand. An orifice is formed within the body of the inner shell 110 to receive the rod there through. The rod is of sufficient length and diameter to extend through the central opening of the hub, of the tape spool, to allow the roll of adhesive tape 142 to rotate freely about the axis, within cavity 140, while preventing the roll of adhesive tape 142 from falling out. As is better illustrated in FIG. 3, outer shell 124 includes a rod receiver 152 comprising an opening for threadably receiving the threaded distal end of the rod. Roll fastener 148 of FIG. 2 is disengage able to accommodate replacement of the roll of adhesive tape 142. Users rotate the knob 150 by hand to unthread the threaded distal end of the rod out from rod receiver 152 and the rod is retrieved from the lateral opening of the hub. In one alternative embodiment, roll fastener 148 may include a braking mechanism or friction engagement to provide controlled rotation of the roll of adhesive tape 142. Nylon bearings or bushings may be incorporated to provide mechanical rotation for roll fastener 148. It will be understood that roll fastener 148 may comprise a spring detent fastener, a removable spring pin, or other mechanism for removably retaining a roll of adhesive tape 142 within the cavity 140 of adhesive tape dispenser 100.

A circular reel opening 154 is formed within the body of the inner shell 110 to accommodate a take-up reel 156 of releasable layer, such as paper. Take-up reel 156 is defined by a length of releasable backing that is collectively wound on a take-up spool 158, as better illustrated in FIG. 4. A first and second finger opening 160, 162 is formed along the circular perimeter of the reel opening 154 to permit users to easily and quickly remove the take-up reel 156 from the adhesive tape dispenser 100 when the take-up reel 156 is full with the releasable backing 400. Finger openings 160, 162 are preferably sized to accommodate adult finger tips to allow the finger tips to slide freely therein without difficulty. In one alternative embodiment, adhesive tape dispenser 100 may include a spring biased ejector that mechanically cooperates with the take-up reel 156 to eject the take-up reel 156 from the reel opening 154 when the biased ejector is operated by a user.

With continued reference to FIG. 1, adhesive tape dispenser 100 includes a swivel fastener 164 for removably securing the take-up reel 156 within reel opening 154. In the preferred embodiment, swivel fastener 164 includes an arm that is pivotably mounted to pivot stubs 168, via a pin 170. Pivot stubs 168 are integrally formed on the outer surface of inner shell 110. The arm pivots about pivot stubs 168 to allow users to remove take-up reel 156, via, finger openings 160, 162, or to install a new take-up spool 158 on a take-up gear shaft 176. Swivel fastener 164 may include a closing fastener or frictional closure to retain the arm closed. Arm also includes a shaft guide 174 that correspondingly aligns with and receives the distal end of a take-up gear shaft 176, as better illustrated in FIG. 4. The shaft guide 174 is used to structurally and mechanically secure the take-up spool 158 onto the take-up gear shaft 176 when winding the releasable backing 400 from the roll of adhesive tape 122.

The inner and outer shells 110, 124 also include risers 116, 130. A bridge 178 extends between both risers 116, 130 and functionally cooperates with top platforms 114, 128 to provide an entry opening for receiving the end of adhesive tape 300. Top platforms 114, 128 also provide a top closure for protecting the operative components that are housed within the adhesive tape dispenser 100 from dust, dirt and other debris.

Adhesive tape dispenser 100 also includes an application guide 180 having a distal curved edge forming a convex engaging surface. The application guide 180 is mounted along the front end of the tape dispenser 100, via mounting fasteners 182. Mounting fasteners 182 may comprise screws, pins, rods, or nuts and bolts. During use of the adhesive tape dispenser 100, the convex engaging surface butts firmly against an application surface to provide stability and proper alignment of the tape dispenser 100 when applying adhesive tape 300 to a surface. The convex engaging surface presses the adhesive tape 300 against the surface to assure the adhesive material securely adheres to a surface, and helps in smoothing out any wrinkles that may have formed within the applied tape 300. Application guide 180 may be fabricated from a plastic or metal material.

Turning now to FIG. 2, the adhesive tape dispenser 100 includes a pair of guide rolls 184, 186 that are rotatably mounted, via, mounting fasteners 182. Guide rolls 184, 186 guide the adhesive tape 300 out from the discharging end of the tape dispenser 100 as the adhesive tape 300 is extracted between the guide rolls 184, 186. Guide rolls 184, 186 also help retain the adhesive tape 300 flat preventing wrinkling, bulging or bending that may occur while dispensing. Preferably, guide rolls 184, 186 are constructed from a material that will not stick to, or frictionally engage with the adhesive tape 300 when passing through guide rolls 184, 186. Sticking or frictional engagement of the tape 300 may result in the adhesive tape cogging, bunching up, or improperly dispensing. In one embodiment, guide rolls 184, 186 comprise a plastic or nylon material, though metal may also be implemented. As illustrated in FIG. 2, application guide 180 is positioned above, along a vertical axis, guide rolls 184, 186. Conveniently, mounting fasteners 182 are used to secure both the application guide 180 and guide rolls 184, 186. Guide rolls 184, 186 may include bushings, or bearings to provide smooth rotation.

Figure 3:
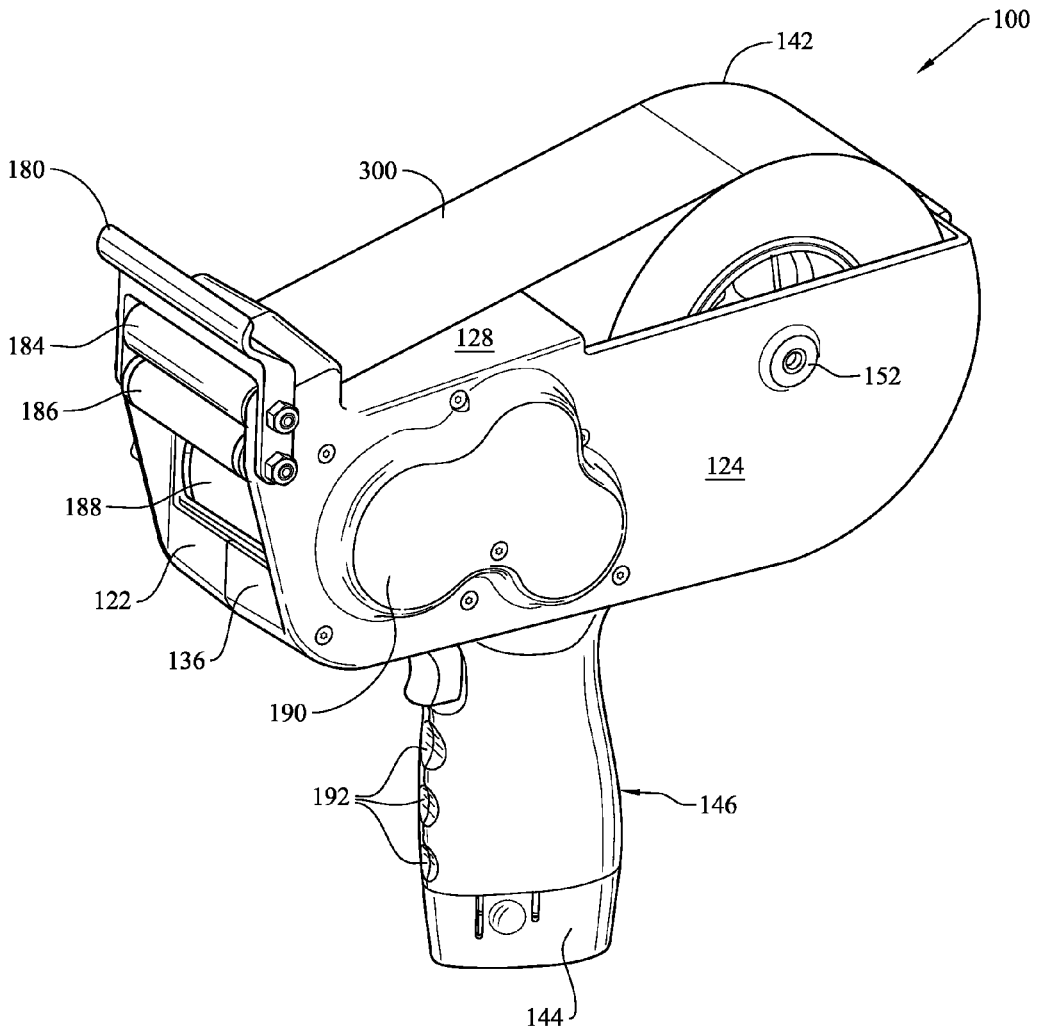
FIG. 3 presents a perspective view of an outer side of the adhesive tape dispenser of FIG. 1, in accordance with the one embodiment of the present invention.

With reference made to FIG. 3, adhesive tape dispenser 100 includes a front opening 188 that is defined by both the inner and outer shells 110, 124 and front walls 122, 136 of bottom platforms 118, 132, respectively. Front opening 188 is tailored to receive the releasably backing 400, of the adhesive tape 300, when the adhesive side of the tape is applied to a surface, as described further below. An expansion region 190 is formed within the body of the outer shell 124 to provide sufficient room for receiving a motorized gear system, as better illustrated in FIGS. 4-6.

Pluralities of finger indentations are formed along a one edge of both hand members 112, 126 to provide a series of finger recesses 192 that are formed along a longitudinal axis of handgrip 146 when both hand members 112, 126 are fastened together. Finger recesses 192 are employed for receiving a user's fingers when grasping the adhesive tape dispenser 100 with one hand. The combinational factor of the handgrip 146 and finger recesses 192 provide added comfort and a firm grip allowing users to manipulate the adhesive tape dispenser 100 with one hand when applying adhesive tape 300 to a surface. The handgrip 146 also helps users to maneuver and negotiate the adhesive tape dispenser 100 in confined or restricted work areas.

Figure 4:
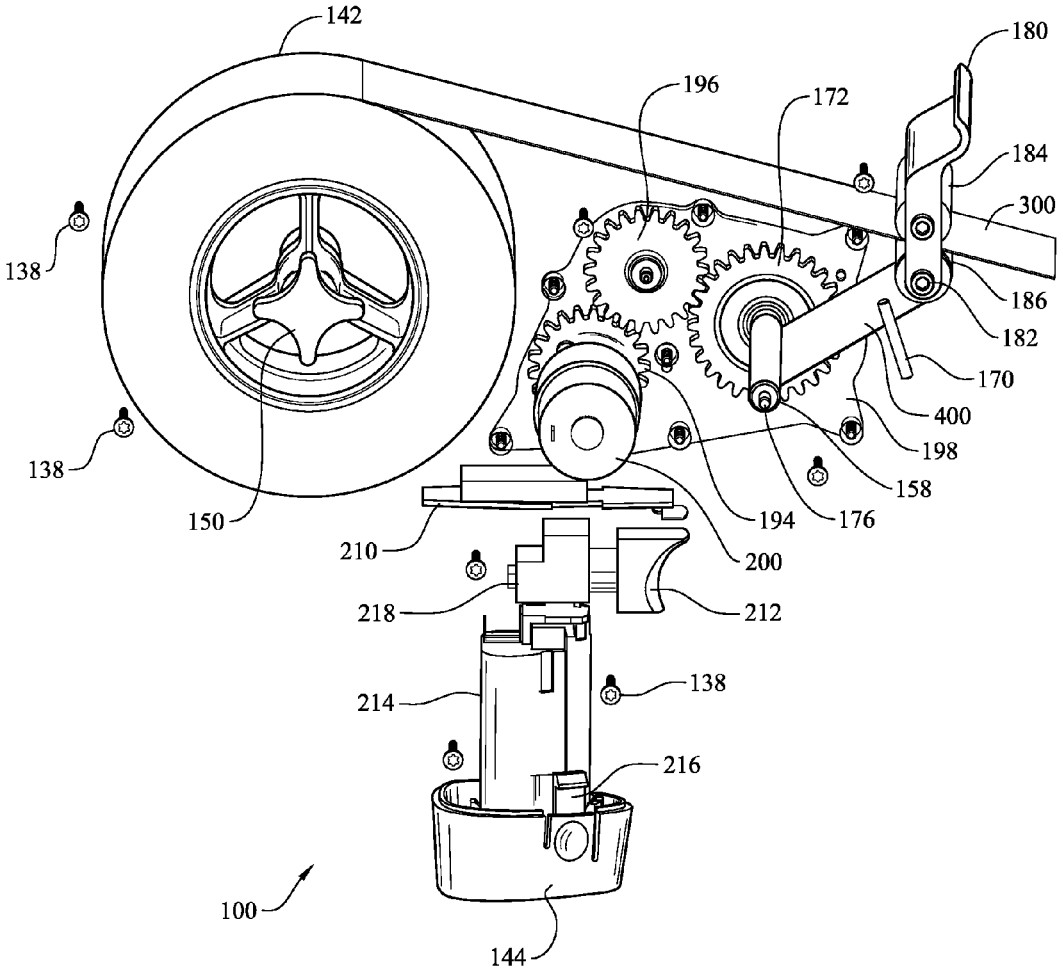
FIG. 4 presents a partial exploded view of the adhesive tape dispenser showing a motorized gear system, with a length of adhesive tape passing through guide rolls and extending forwardly, and a releasable backing removed from the adhesive tape and coiled on a take-up spool, in accordance with the one embodiment of the present invention.

Turning to FIG. 4, there is shown an exploded partial view of the adhesive tape dispenser 100, with a short length of releasable backing 400 wound on a take-up spool 158, in accordance with the present invention. The adhesive tape dispenser 100 provides automatic winding of a releasable backing 400 from a roll of adhesive tape 142 using a motorized gear system that includes a drive gear 194, a planetary gear 196, and a take-up gear 172. Gears 194, 196, 172 are fastened directly to the body of the outer shell 124 or alternatively, to a gear plate 198. The beneficial use of a gear plate 198 allows for quick and easy repair or replacement of the driver gear 194, planetary gear 196, or the take-up gear 172. Each gear 194, 196, 172 includes a predetermined radius and number of teeth selected to provide the requisite arrangement needed for automatically winding releasable backing 400 from the adhesive tape 300 during applications. An electrical DC motor 200 mechanically rotates drive gear 194 in a clockwise direction which in turn drives the planetary gear 196 in a counter-clockwise direction resulting in the take-up gear 172 rotating in a clockwise direction for winding the releasable backing 400. The size and operating characteristics of the DC motor 200 is selected to provide the sufficient amount of torque needed for winding the releasable backing 400 with ease.

An electrical interface for electrically connecting the components needed for providing the automatic winding of releasable backing 400 is provided via, a printed circuit board (PCB) 210. PCB 210 includes electrical connectors for electrically connecting the DC motor 200 to a finger switch 212 and the power source 214. The finger switch 212 comprises an on/off toggle switch and is directly coupled to the power source 214, via, a switch connection block 218. Finger switch 212 may comprise a single pole, single throw, or a double pole double throw switch, and is disposed about handgrip 146 to provide direct accessibility to users when grasping the handgrip 146, of the adhesive tape dispenser 100, with one hand. Handgrip 146 includes a switch opening to accommodate finger switch 212. Power source 214 comprises one or more replaceable or rechargeable batteries or a battery pack designed to fit snuggly within handgrip 146. In one alternative embodiment, the adhesive tape dispenser 100 may include a charging port (not shown) disposed on the bottom of the handgrip 146 and electrically coupled to power source 214. The adhesive tape dispenser 100 may include a charger or docking station where the adhesive tape dispenser 100 is seated within the charger or docking station to charge the power source 214, via the charging port located on handgrip 146.

As illustrated in FIG. 4, end cap 144, of handgrip 146, includes a pair of spring detents 216 that operatively engage detent grooves (not shown) formed along the interior surfaces of both the inner and outer shell grips 110, 124. This feature allows users to quickly and easily depress the spring detents 216 to remove the end cap 144 for quickly replacing the power source 214.

Figure 5:
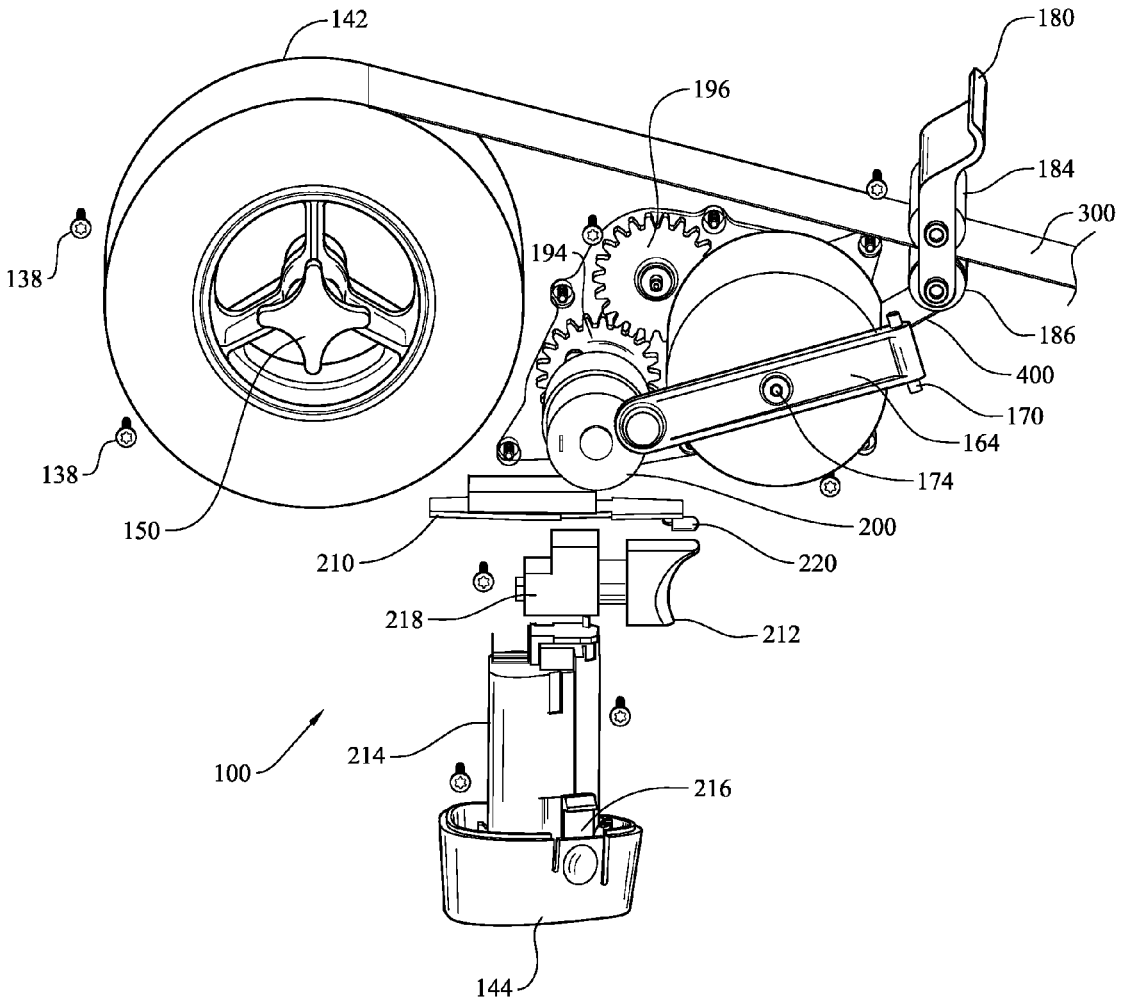
FIG. 5 presents a partial exploded view of the adhesive tape dispenser of FIG. 4, with a partial length of adhesive tap extending forwardly, and a roll of the releasable backing coiled on a take-up spool with a swivel fastener removably securing the roll of releasable backing within the adhesive tape dispenser, and a lighting device, in accordance with the one embodiment of the present invention.

With reference now made to FIG. 5, there is shown an exploded partial view of the adhesive tape dispenser 100, with a take-up reel 156 that comprises a length of releasable backing 400 that is wound on a take-up spool 158, in accordance with the present invention. After using the adhesive tape dispenser 100 for an extended period of time, a greater amount of releasable backing 400 is wound and stored on a take-up spool 158. Swivel fastener 164 is pivotably closed about pivot pin 170 to retain the take-up spool 158 in place, and to prevent the take-up reel 156 defined by the releasable backing 400 wound on the take-up spool 158, within reel opening 154 of the adhesive tape dispenser 100, as also illustrated in FIG. 1. It will be noted that an elongated slit may be formed within the take-up spool 158 to securely receive the end of the releasable backing 400 in preparation for winding. Alternatively, the releasable backing 400 may be wound directly on the take-up gear shaft 176, eliminating the need for the use of a take-up spool 158.

A light source, such as a bright light emitting diode LED 220 is included within the adhesive tape dispenser 100 to illuminate working surfaces in dark or low lit areas. In certain situations, the adhesive tape dispenser 100 may be used in dark or dim lit areas making it difficult for users to successfully apply adhesive tape 300 to surfaces. Repair may be required on ducting that is located in attics, closets or basements. In such circumstances, users are often forced to install external lighting or carry a flashlight to illuminate the surfaces of duct work. The implementation of a light, such as an LED 220 or an incandescent bulb addresses this problem. In one non-limiting embodiment, to help conserve power, LED 220 is electrically connected to finger switch 212 and power source 214 such that the LED 220 is only powered when finger switch 212 is activated. In one embodiment, LED 220 is disposed directly above finger switch 212 and aligned with an LED opening that is formed about a top portion of handgrip 146. Alternatively, LED 220 may be situated anywhere along the front end of the adhesive tape dispenser 100, such as below, or in one or both front walls 122, 136. In another embodiment, a separate electrical switch may be included within the handgrip 146 to power the LED 220 without having to operate the motorized gear system of the adhesive tape dispenser 100. For example, users may wish to see if the adhesive tape 300 is properly applied and in doing so wish only to use the LED 220 and not activate the motorized gear system, via finger switch 212.

Figure 6:
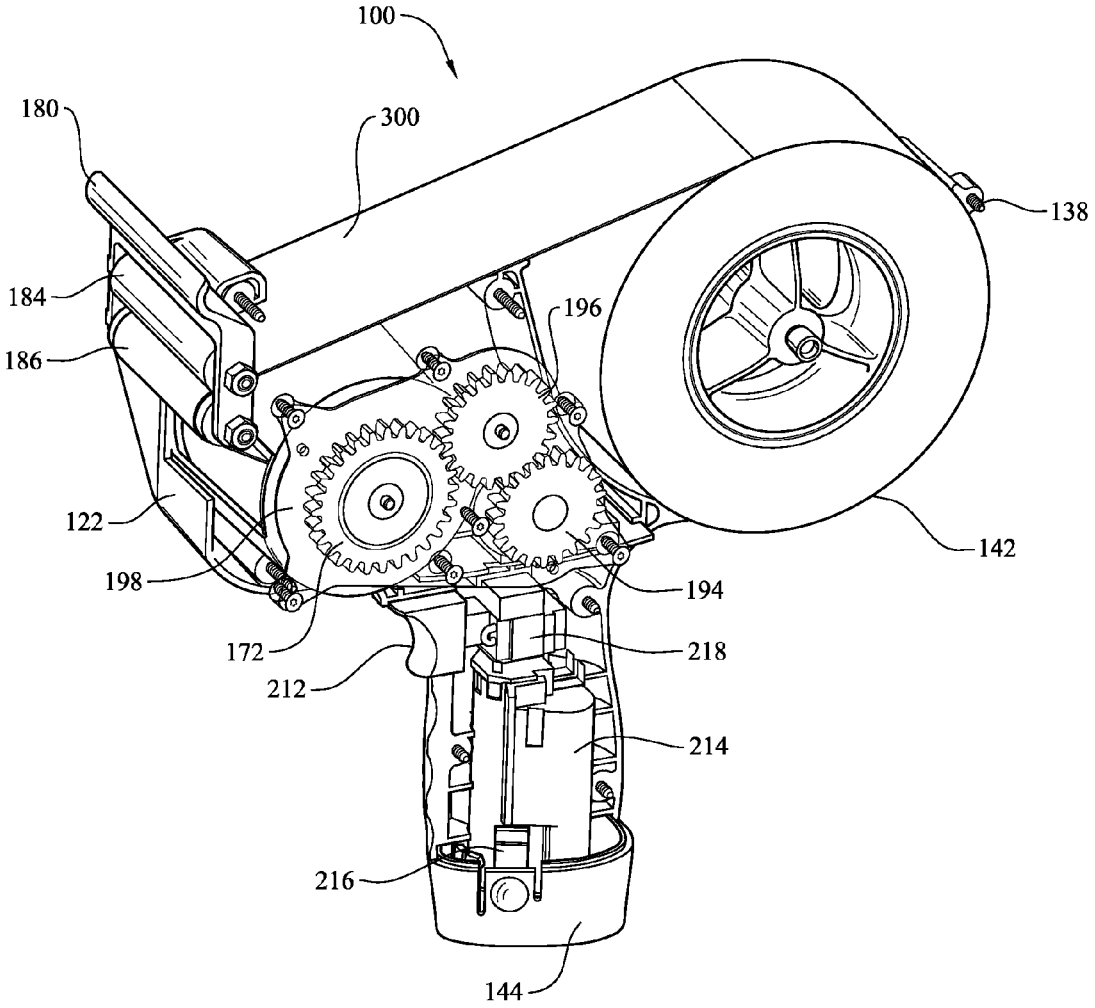
FIG. 6 presents a perspective view of the outer side of the adhesive tape dispenser, with an outer shell removed to show the motorized gear system, a finger switch, and a power supply, in accordance with the one embodiment of the present invention.

As illustrated in FIG. 6, drive gear 194, planetary gear 196, take-up gear 172, DC motor 200, and PCB 210 are safely enclosed within the housing formed by the inner shell 110 and outer shell 124 preventing exposure of the components to dust and other debris. Maintenance, or repair to the gears 194, 196, 172 or DC motor 200 is achieved by simply unfastening shell fasteners 138 to separate shells 110, 124. Finger switch 212 and power source 214 are safely housed within the handgrip 146 as end cap 144 forms a bottom closure of handgrip 146, via spring detents 216. Access to the power source 214 is quickly achieved by depressing spring detents 216 and removing end cap 144.

Figure 7:
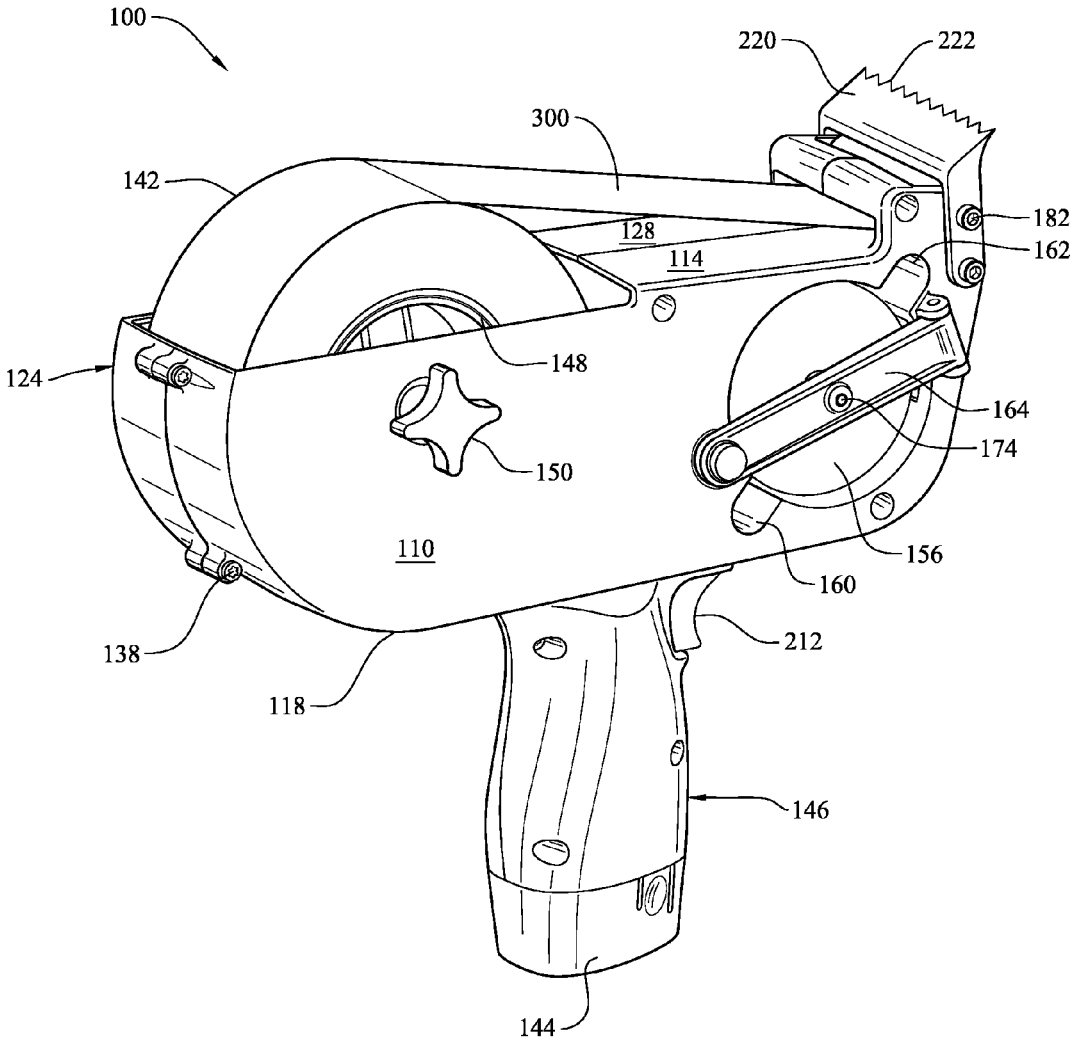
FIG. 7 presents a perspective view of an adhesive tape dispenser, showing an application guide having a serrated cutting edge, in accordance with another embodiment of the present invention.

An alternative embodiment of the present invention is illustrated in FIG. 7. The adhesive tape dispenser 100 comprises the same components and functionality as shown and described in FIGS. 1-6, with the exception of the application guide 180 being replaced with a cutter 222 having a serrated cutting edge 224 for cutting a desired length of adhesive tape 300 when extracted from the adhesive tape dispenser 100. A protective cover (not shown) may be implemented to cover the cutting edge 224 of the cutter 222 when not in use to promote safety and protect individuals when using the adhesive tape dispenser 100.

In operation, with the roll fastener 148 initially removed, a roll of adhesive tape 142 having a releasable backing 400, such as wax paper, is inserted within cavity 140, of the adhesive tape dispenser 100, and the rod of the roll fastener 148 is inserted through the hub of the roll spool. The user rotates knob 150 such that the distal threaded end of the rod is fastened within rod receiver 152, rotatably securing the roll of adhesive tape 142 in place. The end of the adhesive tape 300 is inserted within the opening formed by bridge 178 and top platforms 114, 128 and the adhesive tape 300 extends between guide rolls 184, 186. With a small section of the adhesive tape 300 extending outwards between guide rolls 184, 186, the user peels a portion of the releasable backing 400 away from the adhesive tape 300 prior to application of the adhesive tape 300 to a surface. The releasable backing 400 is inserted within the front opening 188, of the adhesive tape dispenser 100, and is attached to take-up spool 158, or directly to the take-up gear shaft 176. Swivel fastener 164 is securely closed to retain the take-up spool 158 in place on take-up gear shaft 176, via shaft guide 174. The user holds the adhesive tape dispenser 100 in one hand by grasping handgrip 146 and as the user applies adhesive tape 300 to a surface, the user simultaneously depresses finger switch 212 to operate DC motor 200 to rotate the drive gear 194, planetary gear 196 and the take-up gear 172 for automatically and simultaneously winding the releasable backing 400 onto take-up spool 158 to generate a take-up reel 156 of releasable backing paper 400. To remove the take-up reel 156, the user simply unfastens swivel fastener 164 and removes the take-up reel 156, via, finger openings 160, 162 formed about reel opening 154.

The adhesive tape dispenser 100 of the present invention provides an automatic method of winding a releasable backing 400 from adhesive tape 300 while simultaneously applying the adhesive tape 300 to a surface. The adhesive tape dispenser 100 includes a handgrip 146 for conveniently holding the dispenser 100 in one hand, a finger switch 212 oriented on the handgrip 146 and electrically coupled to a motorized gear system for selectively winding the releasable backing 400. An LED 220 is included to illuminate the application surface in dark or low lit areas. A removable end cap 144 allows users to easily and quickly replace power source 214 while on the job site. The releasable backing 400 is easily stored on a take-up spool 158 to provide a take-up reel 156, and the take-up reel 156 is efficiently removed for disposal, thus eliminating the need of having to continuously cut and dispose of the releasable backing 400 when applying adhesive tape 300 to a surface.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A adhesive tape dispenser adapted to dispense adhesive tape stored on a spool and and having a backing substrate, said adhesive tape dispenser comprising:

a frame including a cavity in which said spool of adhesive tape is rotatably mounted therein, and a handgrip extending downwards from said frame and including a removable end cap;

an application guide attached at a distal end of said frame;

a pair of rollers mounted at said distal end of said frame, said adhesive tape disposed between said pair of rollers when extracted from said dispenser;

a spool fastener removably fastened to accommodate replacement of said spool of adhesive tape;

a collection chamber formed within said frame and adapted to store said backing substrate as said backing substrate is removed from said adhesive tape and wound into a coil;

a removable closure closing said collection chamber to prevent said coil from exiting said collection chamber;

a driver gear, a planetary gear, and a take-up gear aligned to rotate within said collection chamber, said gears interconnected with each other to rotate;

an electrical motor mechanically coupled to said driver gear;

a power source secured within said handgrip by said end cap; and an electrical switch disposed within said handgrip and protruding out from a switch opening formed within said handgrip so that users may operate said electrical switch with a finger when holding said handgrip in one hand, said electrical switch selectively operated to electrically couple said power source to said motor to rotate said driver gear so that said take-up gear winds said backing substrate within said collection chamber to form said coil.

2. The adhesive tape dispenser of claim 1, further including access openings to accommodate fingers of individuals, access openings being formed about said collection chamber for removing said coil of said backing substrate.

3. The adhesive tape dispenser of claim 2, further including a printed circuit board for electrically interfacing said electrical motor to said power source, via said electrical switch.

4. The adhesive tape dispenser of claim 3, further including a light emitting diode mounted onto said printed circuit board and situated above said finger switch to illuminate an application surface when using said adhesive tape dispenser, said light emitting diode electrically coupled to said electrical switch and said power source so that said light emitting diode is powered when said electrical switch is activated.

5. The adhesive tape dispenser of claim 4, wherein said application guide includes a serrated edge for cutting said adhesive tape.

6. A releasable sheet tape dispenser comprising:

a handheld housing including a pistol grip and top opening having a disengagable fastener to accommodate replacement of a roll of adhesive tape including a releasable sheet, said housing having a distal opening to receive said releasable sheet;

a pair of rollers aligned vertically one top of each other to rotatably engage said adhesive tape;

a cavity formed within the housing and adapted to receive and store said releasable sheet as said releasable sheet is removed from said adhesive tape and wound within said cavity to form a roll of releasable sheet, said cavity including a removable closure to prevent said roll from exiting said cavity;

interconnecting gears enclosed within said housing and releasably attached to said releasable sheet;

an electric motor coupled to said interconnecting gears;

a power source;

an electrical switch situated about said pistol grip and selectively connecting said power source to said electric motor to wind said releasable sheet within said cavity simultaneously as said adhesive tape is extracted through said pair of rollers; and an interchangeable guide attached to said distal end of said housing.

7. The releasable sheet tape dispenser of claim 6, wherein said interconnecting gears includes a driver gear, a planetary gear, and a take-up gear, said driver gear mechanically coupled to said electric motor and said gears rotatably interconnected together and attached to a gear plate that is secure within said housing.

8. The releasable sheet tape dispenser of claim 7, further including a printed circuit board for electrically interfacing said electric motor to said power source, via said electrical switch.

9. The releasable sheet tape dispenser of claim 8, further including a light emitting diode mounted onto said printed circuit board and powered to illuminate an application surface when using said releasable sheet tape dispenser, said light emitting diode electrically coupled to said electrical switch and said power source so that said light emitting diode is powered when said electrical switch is activated.

10. The releasable sheet tape dispenser of claim 6, wherein said releasable sheet comprises any one of foil, wax paper, plastic, or vinyl.

* * * * *